United States Patent [19]

Ona et al.

[11] Patent Number: 4,645,691

[45] Date of Patent: Feb. 24, 1987

[54] METHOD FOR TREATING MATERIALS WITH ORGANOPOLYSILOXANE COMPOUNDS

[75] Inventors: Isao Ona; Masaru Ozaki, both of Chiba, Japan

[73] Assignee: Toray Silicone Co., Ltd., Tokyo, Japan

[21] Appl. No.: 811,603

[22] Filed: Dec. 20, 1985

[30] Foreign Application Priority Data

Dec. 21, 1984 [JP] Japan ..... 59-271345

[51] Int. Cl.[4] ..... B05D 1/12

[52] U.S. Cl. ..... 427/180; 427/387; 428/447; 524/858; 524/860; 528/17; 528/18; 528/19; 528/35

[58] Field of Search ..... 427/387, 180; 428/447; 524/860, 858; 528/35, 17, 18, 19

[56] References Cited

U.S. PATENT DOCUMENTS

| | | | |
|---|---|---|---|
| 3,828,087 | 8/1974 | Pittman et al. | 528/35 |
| 4,283,519 | 8/1981 | Pines et al. | 528/26 |
| 4,302,571 | 11/1981 | Arai et al. | 528/35 |
| 4,504,549 | 3/1985 | Pines et al. | 427/387 |

*Primary Examiner*—Melvyn I. Marquis

*Attorney, Agent, or Firm*—George A. Grindahl

[57] ABSTRACT

A method for treating a solid material to give it hydrophilic and/or antistatic properties comprises applying a composition containing a silicone compound to the material which has one or more alkoxysilylalkyl groups and one or more polyoxyalkylene groups. In a preferred embodiment the method is used to treat fibers and fiber-containing materials. The composition can further contain a curing agent for the silicone. Emulsion compositions are particularly useful.

23 Claims, No Drawings

METHOD FOR TREATING MATERIALS WITH ORGANOPOLYSILOXANE COMPOUNDS

BACKGROUND OF THE INVENTION

The present invention relates to a method for treating solid materials. More specifically, the present invention describes a method for treating solid materials which imparts a durable antistaticity and durable hydrophilicity to the solid material.

Solid materials such as moldings, sheets, foams, fibers and powders have heretofore been treated with various organic surfactants such as cationic, anionic and nonionic surfactants in order to impart antistaticity and hydrophilicity. However, while such methods do temporarily provide antistaticity and hydrophilicity, they suffer from the drawback of a lack of durability because the coated surfactant is easily removed by water or an organic solvent.

On the other hand, Japanese Pat. No. 44-6069 (69-6069) describes a silicone antistatic in the form of an organo-polysiloxane-polyoxyalkylene copolymer; however, said method again cannot provide a durable antistaticity and durable hydrophilicity because said silicone is easily removed by water or an organic solvent.

BRIEF SUMMARY OF THE INVENTION

It is an object of the present invention to provide a method for rendering a solid material antistatic and hydrophilic. It is also an object of the present invention to provide a method for providing a durable silicone treatment for a solid material. It is a particular object of this invention to provide a method for conferring hydrophilicity and antistaticity properties to fibers and fiber-containing materials.

These objects, and others which will become apparent upon consideration of the following disclosure and appended claims, are obtained by the method of this invention which, briefly stated, comprises treating a solid material with a composition which comprises, as its principal component, an organo-polysiloxane compound which contains at least one siloxane unit bearing an alkoxysilylalkyl radical and at least one siloxane unit bearing a polyoxyalkylene radical, at least one of which is at the terminal portion of a siloxane chain.

In a preferred embodiment of this invention at least one of the siloxane chain-terminating radicals is an alkoxysilylalkyl radical.

DETAILED DESCRIPTION OF THE INVENTION

The present invention relates to a method comprising applying to a solid material a composition comprising an organopolysiloxane compound which contains at least one siloxane unit having the formula $X_aR_{(3-a)}SiR'Si(R)_bO_{(3-b)/2}$ and at least one siloxane unit having the formula $R''(OC_3H_6)_c(OC_2H_4)_dOR'Si(R)_eO_{(3-e)/2}$, any remaining siloxane units in the organopolysiloxane having the formula $R_fSiO_{(4-f)/2}$ wherein, at each occurrence, X denotes an alkoxy or alkoxyalkoxy radical having from 1 to 4 carbon atoms, R denotes a monovalent hydrocarbon or halogenated hydrocarbon radical having from 1 to 10 carbon atoms, R′ denotes an alkylene radical having from 2 to 10 carbon atoms, R″ denotes a hydrogen atom or a monovalent organic radical having from 1 to 5 carbon atoms, a has a value of 2 or 3, b has a value of 0, 1 or 2, c has a value of from 0 to 50, d has a value of from 0 to 50, c plus d has a value of from 2 to 100, e has a value of 1 or 2 and f has a value of from 0 to 3, there being, per molecule of said organopolysiloxane compound, an average of at least one siloxane unit wherein b or e has a value of 2.

By way of explanation, the organopolysiloxane compound of the present invention must contain, in each molecule, an average of at least 1 unit with the formula $$X_a-\overset{\overset{\displaystyle R_{(3-a)}}{|}}{Si}-R'-\overset{\overset{\displaystyle R_b}{|}}{Si}O_{(3-b)/2} \quad (1)$$

and an average of at least 1 unit with the formula $$R''-(OC_3H_6)_c(OC_2H_4)_d-O-R'-\overset{\overset{\displaystyle R_e}{|}}{Si}O_{(3-e)/2} \quad (2)$$

The former unit is needed to increase the bonding and affinity to solid materials as well as to provide durability by the condensation reaction of the alkoxy groups at the molecular terminals with an increase in molecular weight. The latter unit is needed to impart antistaticity and hydrophilicity to the solid material.

In the preceding formulae, X is any alkoxy group or any alkoxyalkoxy group having from 1 to 4 carbon atoms and concrete examples thereof are methoxy, ethoxy, propoxy and methoxyethoxy. R′ represents any alkylene group having from 2 to 10 carbon atoms and concrete examples thereof are ethylene, propylene, butylene and hexylene. Each R represents any monovalent hydrocarbon group or halogenated monovalent hydrocarbon group having from 1 to 10 carbon atoms and concrete examples thereof are alkyl groups such as methyl, ethyl, propyl and octyl; alkenyl groups such as vinyl, allyl and propenyl; substituted alkyl groups such as 2-phenylethyl, 2-phenylpropyl and 3,3,3-trifluoropropyl; aryl groups such as phenyl and tolyl and substituted aryl groups. R″ represents a hydrogen atom or any monovalent organic group having from 1 to 5 carbon atoms. Concrete examples of said monovalent organic groups are monovalent hydrocarbon groups such as methyl, ethyl, propyl, cyclohexyl, phenyl and β-phenylethyl; acryl groups and the carbamyl group.

In the preceding formulae a is 2 or 3, b is an integer with a value of 0, 1 or 2, c and d both represent integers with values of 0 to 50, (c+d) has a value of 2 to 100 and e is 1 or 2.

Organosiloxane units with formula (1) are exemplified by $(CH_3O)_3Si(CH_2)_2(CH_3)SiO_{2/2}$, $(CH_3O)_2(CH_3)Si(CH_2)_2(CH_3)_2SiO_{1/2}$, $(C_2H_5O)_3Si(CH_2)_3SiO_{3/2}$, $(C_2H_5O)_2(C_6H_5)Si(CH_2)_2(CH_3)_2SiO_{1/2}$, $(C_3H_7O)_3Si(CH_2)_2(CF_3CH_2CH_2)SiO_{2/2}$, and $(C_4H_9O)_3Si(CH_2)_3(C_2H_5)_2SiO_{1/2}$.

Organosiloxane units with formula (2) are exemplified by $H(OC_3H_6)_{20}(OC_2H_4)_{20}O(CH_2)_3CH_3SiO_{2/2}$, $H(OC_2H_4)_{10}O(CH_2)_5C_2H_5SiO_{2/2}$, $H(OC_3H_6)_{15}O(CH_2)_3(CH_3)_2SiO_{1/2}$, $CH_3(OC_3H_6)_{50}(OC_2H_4)_{30}O(CH_2)_3(CH_3)_2SiO_{1/2}$, $C_2H_5(OC_2H_4)_{60}O(CH_2)_8SiO_{3/2}$, $CH_3CO(OC_3H_6)_{25}(OC_2H_4)_{15}O(CH_2)_6C_6H_5SiO_{2/2}$, and $C_2H_5CO(OC_3H_6)_{10}(OC_2H_4)_{40}O(CH_2)_2CF_3CH_2CH_2SiO_{3/2}$.

Said organopolysiloxane must necessarily contain the two types of units mentioned above. It may be constituted only of those two types of units or it may further contain organosiloxane units having the formula $R_fSiO_{(4-f)/2}$ wherein f has a value of from 0 to 3. The Si-bonded groups in such other organosiloxane units comprise monovalent hydrocarbon groups, whose concrete examples are as cited for R', above.

The other organosiloxane units are exemplified by $SiO_{4/2}$, $(CH_3)_2SiO$, $(CH_3)_3SiO_{1/2}$, $CH_3SiO_{3/2}$, $(CH_3)(CF_3CH_2CH_2)SiO_{2/2}$, $(CH_3)(C_6H_5)SiO$, and $C_6H_5(CH_2)_2SiO_{3/2}$.

The organopolysiloxanes that are used in the method of this invention contain at least one terminating siloxane unit having the formula (1) or (2) above. That is to say, the value of b or e must be 2, thereby giving rise to terminating radicals having the formulae $X_aR_{(3-a)}SiR'Si(R)_2O_{1/2}$ and $R''(OC_3H_6)_c(OC_2H_4)_dOR'Si(R)_2O_{1/2}$.

The molecular structure of said organopolysiloxane is straight chain, branched chain, cyclic or network. The degree of polymerization of, and molar ratio in, said organopolysiloxane are arbitrary; however, they are advantageously determined under the condition that each molecule contain a total of 5 to 500 siloxane units from the stand point of ease of treatment. When the total number of siloxane units is equal to or greater than 50, lubricant properties appear.

In a preferred embodiment of the method of this invention the organopolysiloxane compound has a substantially linear structure with the formula $A(R_2SiO)_x(RQSiO)_y(RGSiO)_zSiR_2A$. In this formula Q denotes the above-noted radical having the formula $—R'SiX_aR_{(3-a)}$, G denotes the above-noted radical having the formula $R'O(C_2H_4O)_d(C_3H_6O)_cR''$, A denotes a siloxane chain-terminating radical selected from the group consisting of R, Q and G radicals, x has a value of from 1 to 500, y has a value of from 0 to 100 and z has a value of from 0 to 100, at least one A radical being a Q radical or a G radical. The A radicals can be the same or different, as desired.

To increase the likelihood that substantially all of the molecules in the compound will durably adhere to a solid material when it is applied thereto it is preferred that at least one of said terminating radicals is a Q radical. To assure that substantially all of the molecules in the compound will durably adhere to a solid material when it is applied thereto it is preferred that both of said terminating radicals are Q radicals.

In the above formula the arrangement of the disubstituted siloxane units is not critical; however, it is typically an approximately random arrangement. The arrangement of the siloxane units in the above formula has the conventional meaning and is not to be interpreted as requiring a block type arrangement of siloxane units. Furthermore, although the compounds of this invention are described as having a linear molecular structure, the presence of trace amounts of branching siloxane units having the formulae $SiO_{3/2}$ and $SiO_{4/2}$, frequently present in commercial organopolysiloxanes, are contemplated herein.

Concrete examples of the linear compounds used in this invention include, but are not limited to, those shown in the examples disclosed below and the following:

$$(MeO)_3SiCH_2CH_2(Me_2SiO)_{100}(\underset{\substack{|\\ HO(EO)_{10}(PO)_{10}(CH_2)_3}}{MeSiO})_{20}(\underset{\substack{|\\ CH_2CH_2Si(OMe)_3}}{MeSiO})_{20}SiMe_2CH_2CH_2Si(OMe)$$

$$(EtO)_3SiCH_2CH_2(Me_2SiO)_{50}(\underset{\substack{|\\ CH_3CO_2(EO)_{30}(PO)_{30}(CH_2)_3}}{MeSiO})_{20}(\underset{\substack{|\\ CH_2CH_2Si(OMe)_3}}{MeSiO})_{10}SiMe_2CH_2CH_2Si(OEt)_3$$

$$Me_3SiO(Me_2SiO)_{50}(\underset{\substack{|\\ (MeO)_3SiCH_2CH_2}}{MeSiO})_8(\underset{\substack{|\\ CH_2CH_2CH_2O(EO)_{30}(PO)_{10}Me}}{MeSiO})_{18}SiMe_2CH_2CH_2Si(OMe)_3$$

$$MeO(EO)_4CH_2CH_2CH_2(\underset{\substack{|\\ MeO(EO)_{10}(PO)_5(CH_2)_3}}{Me_2SiO})_{20}(\underset{\substack{|\\ (CH_2)_{30}(EO)_{10}(PO)_5Me}}{MeSiO})_5(CH_2CH_2Si(OMe)_3)SiMe_2$$

$$HO(PO)_{10}CH_2CH_2CH_2(HO(PO)_{10}(CH_2)_3(Me_2SiO)_{50}(MeSiO)_{10}(CH_2CH_2Si(OEt)_3)MeSiO)_5SiMe_2(CH_2)_3O(PO)_{10}H$$

as well as compounds in which one silicon-bonded methyl group at the end of the preceding compounds is changed to phenyl or 3,3,3-trifluoropropyl, compounds in which all or part of the dimethylsiloxane units are changed to methylphenylsiloxane units or methyloctylsiloxane units and compounds in which some or all of the dimethylsiloxane units are changed to methyl(3,3,3-trifluoropropyl)siloxane units. Herein Me, Et, EO and PO denote $CH_3$, $CH_3CH_2$, $C_2H_4O$ and $C_3H_6O$, respectively.

The organopolysiloxane used by the present invention can be produced, for example, by the addition reaction of an organopolysiloxane with the formula $$H_3C[(CH_3)_2SiO]_{50}[CH_3(H)SiO]_5(CH_3)_3$$

with an organosilane with the formula $$CH_2{=}CHSi(OCH_3)_3$$

and a polyoxyalkylene with the formula $$CH_2{=}CHCH_2O(C_2H_4O)_{10}(C_3H_6O)_5H$$

in the presence of a platinum-type catalyst.

To use the composition for treating solid materials, said organopolysiloxane can be used alone or it can be dissolved or auto-emulsified in water or emulsified in water using an appropriate emulsifier such as the salt of the sulfate ester of a higher alcohol, alkylbenzenesulfonate salts, higher alcohol-polyoxyalkylene adducts, higher fatty acid-polyoxyalkylene adducts, alkylphenol-polyoxyalkylene adducts and higher fatty acid-sorbitan esters, etc.

Alternatively, the organopolysiloxane can be dissolved prior to use in an organic solvent such as toluene, xylene, benzene, $\eta$-hexane, heptane, acetone, methyl ethyl ketone, methyl isobutyl ketone, ethyl acetate, butyl acetate, mineral terpene, perchloroethylene or trichloroethylene, etc.

The solid material can be treated by the method of the present invention by spraying, roll coating, brush coating or immersing the solid material. The coating quantity of the agent is arbitrary and depends on the type of solid material treated; however, it is generally 0.01 to 10.0 weight percent based on the solid material. Solid materials coated with the composition of the present invention will have a durable antistaticity and durable hydrophilicity after standing at room temperature or after heating, such as by blowing with hot air.

In addition, the compositions of the present invention may be jointly applied to a solid material with a curing agent such as a silanol curing catalyst such as the zinc, tin or zirconium salts of an organic acid, such as zinc stearate, zinc oleate, dibutyltin diacetate, dibutyltin dioleate, dibutyltin dilaurate or zirconium stearate and/or silanol crosslinking compound such as an alkoxysilane such as an amino group-containing alkoxysilane or an epoxy group-containing alkoxysilane, an organohydrogenpolysiloxane, or a silanol group-containing organopolysiloxane.

Solid materials to which the compositions of the present invention can be applied are exemplified by various fibers and the textiles of said fibers; sheet materials such as paper, natural and synthetic leathers, cellophane and plastic films; foams such as synthetic resin foams; moldings such as synthetic resin moldings, natural and synthetic rubber moldings, metal moldings, glass moldings; and powder materials such as inorganic powders and synthetic resin powders.

The fibers are exemplified by natural fibers such as hair, wool, silk, flax, cotton and asbestos; regenerated fibers such as rayon and acetate; synthetic fibers such as polyester, polyamide, vinylon, polyacrylonitrile, polyethylene, polypropylene and spandex; glass fibers; carbon fibers; and silicon carbide fibers. Fiber forms include staple, filament, tow and yarn. Concrete examples of the textiles are knits, weaves, nonwovens, resin-processed fabrics and their sewn products.

EXAMPLES

The present invention will be explained using examples of execution. "Parts" and "%" in the examples denote "weight parts" and "weight percent", respectively. The viscosity is the value measured at 25° C.

The organopolysiloxanes used in the examples have the following structural formulas.

A.

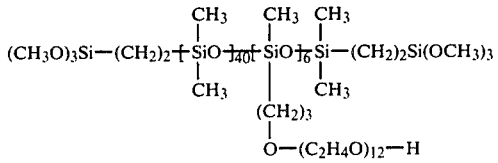

viscosity 1100 cs

B.

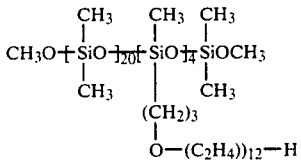

viscosity 500 cs

C.

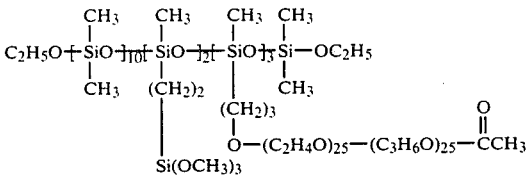

viscosity 300 cs

D.

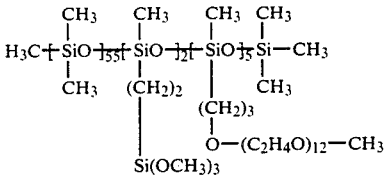

viscosity 1200 cs

E.

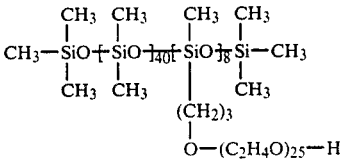

viscosity 1000 cs

EXAMPLE 1

Five parts of each of organopolysiloxanes A to E are respectively combined with and dissolved to homogeneity in 995 parts each of toluene to produce treatment liquids (a), (b), (c), (d) and (e).

Five pieces of 65% polyester/35% cotton broadcloth (size, 40×20 cm each) which had been coated with 3% glyoxal-type resin are respectively immersed in these treatment baths for 30 seconds with a 100% mangle expression, allowed to stand and dry at room temperature for 10 hours and then heated in an oven at 150° C.

for 5 minutes. The resulting organopolysiloxane-treated fabrics are each cut into 2 pieces. One piece of each organopolysiloxane-treated fabric is washed once in an automatic reversing washer under the following conditions and then rinsed with water twice (under the same washing conditions with the exception that no detergent is used): bath ratio, 1:50; temperature, 40° C.; detergent, 0.5% aqueous solution of New White (from Lion Corporation); washing time, 10 minutes.

To conduct a test of the water absorptiveness, the washed organopolysiloxane-treated fabrics are all laid out flat on filter paper. A drop of water is placed on each fabric using a fountain pen filler in order to measure the time required for diffusion.

An X-ray fluorescence analyzer (Rigaku Corp.) is used to measure the number of counts of silicon on the treated fabrics both before and after washing and the residual organopolysiloxane (%) after washing is calculated from the difference.

The results are reported in Table 1. Fabric treated with the treatment agent of the present invention has an excellent water absorptiveness and also presents an excellent durability on the part of the water absorptiveness with respect to washing.

TABLE 1

| Organo-poly-siloxane | Treat-ment Bath | Water Absorptiveness | | Residual Organo-polysiloxane After Washing, % |
|---|---|---|---|---|
| | | Pre-Wash | Post-Wash | |
| A | (a) | 3.0 | 6.5 | 51 |
| B | (b) | 4.3 | 5.5 | 45 |
| C | (c) | 2.0 | 4.5 | 45 |
| D | (d) | 3.5 | 6.0 | 48 |
| E | (e) | 3.1 | 10.5 | 11 |
| None | None | 12.5 | 10.0 | — |

EXAMPLE 2

Treatment liquids (a′) to (e′) are prepared by adding 0.5 part of an aminosilane with the formula $$(CH_3O)_3Si(CH_2)_3NH(CH_2)_2NH_2$$

and 0.2 part dibutyltin diacetate to each of treatment liquids (a) to (e) prepared as in Example 1.

Broadcloth as described in Example 1 is similarly treated to give organopolysiloxane-treated fabric which is subsequently washed and tested for water absorptiveness and measured for residual organopolysiloxane by the methods described in Example 1.

The results are reported in Table 2. The combined use of the aminosilane further increases the durability of the water absorptiveness against washing.

TABLE 2

| Organo-poly-siloxane | Treat-ment Bath | Water Absorptiveness | | Residual Organo-polysiloxane After Washing, % |
|---|---|---|---|---|
| | | Pre-Wash | Post-Wash | |
| A | (a′) | 4.5 | 5.0 | 60 |
| B | (b′) | 5.5 | 5.0 | 53 |
| C | (c′) | 5.0 | 5.5 | 55 |
| D | (d′) | 3.5 | 4.5 | 52 |
| E | (e′) | 5.0 | 8.5 | 12 |

EXAMPLE 3

An antistaticity test and an antisoiling test are conducted on organopolysiloxane-treated fabrics treated with treatment baths (a) to (e) of Example 1.

Antistaticity Test

Fabric, untreated or treated with organopolysiloxane and washed or unwashed, is allowed to stand at 20° C./65% RH for 1 week and then rubbed for 60 seconds against a cotton cloth (unbleached muslin No. 3) in a Kyoto University Chemical Research Laboratory rotary static tester at 800 rpm. The triboelectric voltage is immediately measured.

Antisoiling Test

The antisoiling characteristic against oil soiling is measured as followed. An artificial soiling liquid is prepared by adequately grinding and mixing 300 g ASTM No. 1 oil in a mortar with 3 g coal tar, 5 g dried clay powder, 5 g portland cement and 5 g sodium dodecylbenzenesulfonate. Five ml of this artificial soiling liquid and 100 ml of a 0.5% aqueous solution of Marseilles soap are both placed in a 450 ml glass bottle; fabric (5×10 cm), untreated or treated with organopolysiloxane and washed or unwashed, is placed in said glass bottle to which 10 steel balls are then added; and the test fabric is thus immersed and treated at 60° C. for 30 minutes. It is then gently washed with water, dried, washed for 10 minutes with a 0.5% aqueous solution of Marseilles soap in an automatic reversing whirlpool electric washer on "high", rinsed with water and then dried. The reflectance of the resulting test fabric is measured at a wavelength of 550 mμ.

The test results are reported in Table 3. The measured values clearly demonstrate that the treatment agent of the present invention provides the treated fabric with a durable antistaticity and soiling resistance.

TABLE 3

| Organopoly-siloxane | Treatment Bath | Triboelectric Voltage, (V) | | Reflectance at 550 milli-microns, % |
|---|---|---|---|---|
| | | Pre-Wash | Post-Wash | |
| A | (a) | 880 | 1030 | 71 |
| B | (b) | 910 | 1150 | 65 |
| C | (c) | 920 | 1110 | 68 |
| D | (d) | 850 | 1070 | 66 |
| E | (e) | 900 | 1530 | 53 |
| None | None | 1650 | 1610 | 53 |

EXAMPLE 4

Ten parts of each of organopolysiloxanes A, B, C, D and E are respectively combined with 990 parts each of water followed by thorough agitation to prepare 5 types of treatment baths. A piece (40×20 cm) of a mixed 65% polyester/35% cotton raincoat fabric is immersed in each treatment bath for 1 minute with 100% mangle expression and then allowed to stand and dry at room temperature for 3 days. The resulting organopolysiloxane-treated fabrics are each cut into two 20×20 cm pieces. For each fabric, one of the two pieces is washed and post-treated by the method described in Example 1. The crease resistance (%) of the fabrics is measured on the lengthwise texture by the Monsanto method and the flexural rigidity is measured by the Clark method. The lubricity is determined by touch (slipperiness to the touch) and is scored as follows.

S: Very slippery to the touch.

O: Slippery to the touch.

X: Not slippery to the touch.

The results are reported in Table 4. Fabric treated with the treatment agent of the present invention has an excellent lubricity, crease resistance and flexibility, all of which presented little change after washing.

TABLE 4

| Organopolysiloxane | Lubrication | | Crease Resistance, (%) | | Flexural Rigidity, (mm) | |
|---|---|---|---|---|---|---|
| | Pre-Wash | Post-Wash | Pre-Wash | Post-Wash | Pre-Wash | Post-Wash |
| A | S | S-O | 65 | 63 | 52 | 54 |
| B | S | S-O | 63 | 60 | 53 | 55 |
| C | S | S-O | 63 | 62 | 51 | 53 |
| D | S | S-O | 64 | 60 | 53 | 55 |
| E | S | O-X | 64 | 52 | 53 | 60 |
| Untreated | X | X | 52 | 51 | 63 | 62 |

EXAMPLE 5

Ten parts organopolysiloxane A and 1 part zinc stearate are both dissolved in 89 parts water to prepare a treatment liquid which is subsequently coated using a sprayer on one side of a plasma-processed polyethylene terephthalate film to give an organopolysiloxane coat quantity of 0.2 g/m$^2$. The resulting film is dried at room temperature overnight and then heated in an oven at 130° C. for 10 minutes.

For comparison examples, a 10% aqueous solution of organopolysiloxane E and a 10% aqueous solution of a nonionic surfactant (NS-210 from Nippon Oil and Fat Co., Ltd.) are respectively prepared and each is respectively sprayed to give an adhered quantity of 0.2 g/m$^2$ on one side of the same type of plasma-processed polyethylene terephthalate film followed by drying and heating.

The three treated films are immersed in flowing water for 6 hours and then placed smoothly on the water surface in a thermostatted water bath set at 60°±2° C. for 3 hours with the treated surface down. The features of the films are then inspected. The film treated with organopolysiloxane A, the treatment agent of the present invention, retained its hydrophilicity and the down side of the film was uniformly wetted and was transparent. On the other hand, the down sides of the other two films did not present hydrophilicity, but were adhered with water drops and were cloudy.

EXAMPLE 6

Carbon black powder coated with 1% organopolysiloxane A is prepared as follows. 100 g of a 0.5% aqueous solution of organopolysiloxane A is prepared and combined with 50 g carbon black powder and this is allowed to stand and dry and then heated at 100° C. for 5 minutes.

For the comparison example, carbon black powder is coated with 1% organopolysiloxane E by a similar treatment.

Fifty g of each carbon black are respectively combined with 1 l each of water, stirred for 3 hours, filtered off and then dried.

Five parts of each carbon black powder are separately homogeneously dispersed into an aqueous acrylic emulsion paint to prepare paints. The paint containing the carbon black powder treated with organopolysiloxane A presented a uniform dispersion and no settling while the carbon black powder treated with organopolysiloxane E underwent rapid settling to give a nonuniform dispersion. This shows that the agent for treating solid materials of the present invention imparts a durable hydrophilicity.

That which is claimed is:

1. A method comprising applying to a solid material a composition comprising an organopolysiloxane compound which contains at least one siloxane unit having the formula $X_aR_{(3-a)}SiR'Si(R)_bO_{(3-b)/2}$ and at least one siloxane unit having the formula $R''(OC_3H_6)_c(OC_2H_4)_dOR'Si(R)_eO_{(3-e)/2}$, any remaining siloxane units in the organopolysiloxane having the formula $R_fSiO_{(4-f)/2}$ wherein, at each occurrence, X denotes an alkoxy or alkoxyalkoxy radical having from 1 to 4 carbon atoms, R denotes a monovalent hydrocarbon or halogenated hydrocarbon radical having from 1 to 10 carbon atoms, R′ denotes an alkylene radical having from 2 to 10 carbon atoms, R″ denotes a hydrogen atom or a monovalent organic radical having from 1 to 5 carbon atoms, a has a value of 2 or 3, b has a value of 0, 1 or 2, c has a value of from 0 to 50, d has a value of from 0 to 50, c plus d has a value of from 2 to 100, e has a value of 1 or 2, and f has a value of from 0 to 3, there being, per molecule of said organopolysiloxane compound, an average of at least one siloxane unit wherein b or e has a value of 2.

2. A method according to claim 1 wherein the organopolysiloxane compound has the formula $$A(R_2SiO)_x(RQSiO)_y(RQSiO)_zSiR_2A$$

wherein

Q denotes a radical having the formula $-R'SiX_aR_{(3-a)}$,

G denotes a radical having the formula $$-R'O(C_2H_4O)_d(C_3H_6O)_cR'',$$

A denotes a radical selected from the group consisting of R, Q and G radicals, x has a value of from 1 to 500, y has a value of from 0 to 100, and z has a value of from 0 to 100, at least one A radical being a Q radical or a G radical and the compound contains at least one Q radical and at least one G radical.

3. A method according to claim 2 wherein each R radical is a methyl radical.

4. A method according to claim 3 wherein each X radical is a methoxy radical.

5. A method according to claim 4 wherein one A radical is a methyl radical.

6. A method according to claim 4 wherein one A radical is a Q radical.

7. A method according to claim 4 wherein one A radical is a G radical.

8. A method according to claim 4 wherein both A radicals are Q radicals.

9. A method according to claim 4 wherein both A radicals are G radicals.

10. A method according to claim 2 wherein the organopolysiloxane compound has the formula $Me_3SiO(Me_2SiO)_x(MeQSiO)_y(MeGSiO)_zSiMe_2Q$ wherein x, y and z are positive integers and Me denotes methyl.

11. A method according to claim 10 wherein Q denotes the $—CH_2CH_2Si(OMe)_3$ radical.

12. A method according to claim 1 wherein the composition further comprises a curing amount of a curing agent comprising a curing catalyst and/or a crosslinking compound for silanol groups.

13. A method according to claim 1 wherein the composition further comprises water.

14. A method according to claim 1 wherein the solid material comprises a fiber.

15. A method according to claim 14 wherein the composition is an aqueous emulsion of the organopolysiloxane compound.

16. A method according to claim 2 wherein the composition further comprises a curing amount of a curing agent comprising a curing catalyst and/or a crosslinking compound for silanol groups.

17. A method according to claim 2 wherein the composition further comprises water.

18. A method according to claim 2 wherein the solid material comprises a fiber.

19. A method according to claim 18 wherein the composition is an aqueous emulsion of the organopolysiloxane compound.

20. A method according to claim 10 wherein the composition further comprises a curing amount of a curing agent comprising a curing catalyst and/or a crosslinking compound for silanol groups.

21. A method according to claim 10 wherein the composition further comprises water.

22. A method according to claim 10 wherein the solid material comprises a fiber.

23. A method according to claim 22 wherein the composition is an aqueous emulsion of the organopolysiloxane compound.

* * * * *